US008627884B2

(12) United States Patent
Watson

(10) Patent No.: US 8,627,884 B2
(45) **Date of Patent: *Jan. 14, 2014**

(54) SETTING TOOL FOR EXPANDABLE LINER HANGER AND ASSOCIATED METHODS

(75) Inventor: Brock W. Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,896

(22) Filed: Mar. 22, 2011

(65) Prior Publication Data

US 2011/0168408 A1 Jul. 14, 2011

Related U.S. Application Data

(63) Continuation of application No. 11/923,374, filed on Oct. 24, 2007, now Pat. No. 8,100,188.

(51) Int. Cl.
*E21B 23/00* (2006.01)

(52) U.S. Cl.
USPC ..... 166/208

(58) Field of Classification Search
USPC ..... 166/208, 277, 387, 382, 207
See application file for complete search history.

(56) References Cited

U.S. PATENT DOCUMENTS

| | | | | |
|---|---|---|---|---|
| 2,259,232 | A | 10/1941 | Stone | |
| 2,342,930 | A * | 2/1944 | Fortune | 166/158 |
| 3,077,933 | A | 2/1963 | Bigelow | |
| 3,219,116 | A | 11/1965 | Matthews, Jr. | |
| 3,871,449 | A | 3/1975 | Ahlstone | |
| 4,251,176 | A | 2/1981 | Sizer et al. | |
| 4,388,971 | A | 6/1983 | Peterson | |
| 4,391,325 | A | 7/1983 | Baker et al. | |
| 4,681,168 | A | 7/1987 | Kisling, III | |
| 4,848,469 | A | 7/1989 | Baugh et al. | |
| 4,911,237 | A | 3/1990 | Melenyzer | |
| 4,926,936 | A | 5/1990 | Braddick | |
| 5,070,941 | A | 12/1991 | Kilgore | |
| 5,318,131 | A | 6/1994 | Baker | |
| 5,697,449 | A | 12/1997 | Hennig et al. | |
| 6,012,523 | A | 1/2000 | Campbell et al. | |
| 6,053,262 | A | 4/2000 | Ferguson et al. | |
| 6,241,018 | B1 | 6/2001 | Eriksen | |

(Continued)

OTHER PUBLICATIONS

Halliburton, "Versaflex Stimulation Acid Washdown (SAW) System," H05462 dated Jan. 2011, 2 pages.

(Continued)

*Primary Examiner* — David Bagnell
*Assistant Examiner* — Kipp Wallace
(74) *Attorney, Agent, or Firm* — Smith IP Services, P.C.

(57) ABSTRACT

A setting tool for an expandable liner hanger. A method includes the steps of: releasably securing the setting tool to the hanger, the setting tool including an expansion cone for displacing through the hanger; and conveying the setting tool and hanger into the well on a generally tubular work string while no portion of the hanger extends longitudinally between the expansion cone and the work string. A setting tool includes an expansion cone, which is displaceable through the liner hanger to expand the hanger; at least one piston positioned on one side of the expansion cone; and an anchoring device for releasably securing the setting tool to the liner hanger, the anchoring device being positioned on an opposite side of the expansion cone. The expansion cone is pressure balanced between its two sides when the expansion cone is displaced through the liner hanger.

7 Claims, 14 Drawing Sheets

(56) References Cited

U.S. PATENT DOCUMENTS

| | | | | |
|---|---|---|---|---|
| 6,446,724 | B2 * | 9/2002 | Baugh et al. | 166/285 |
| 6,467,547 | B2 | 10/2002 | Maguire et al. | |
| 6,648,075 | B2 | 11/2003 | Badrak et al. | |
| 6,817,421 | B2 | 11/2004 | Dallas | |
| 6,854,521 | B2 | 2/2005 | Echols et al. | |
| 6,915,852 | B2 * | 7/2005 | Baugh et al. | 166/285 |
| 7,011,162 | B2 | 3/2006 | Maguire | |
| 7,048,065 | B2 | 5/2006 | Badrak et al. | |
| 7,077,211 | B2 | 7/2006 | Cook et al. | |
| 7,090,005 | B2 * | 8/2006 | Smith et al. | 166/206 |
| 7,124,829 | B2 | 10/2006 | Braddick | |
| 7,128,147 | B2 | 10/2006 | Marcin et al. | |
| 7,152,684 | B2 | 12/2006 | Harrall et al. | |
| 7,156,182 | B2 | 1/2007 | Lynde et al. | |
| 7,159,666 | B2 | 1/2007 | Nobileau | |
| 7,172,027 | B2 | 2/2007 | Simpson et al. | |
| 7,185,701 | B2 | 3/2007 | Mackenzie | |
| 7,216,701 | B2 | 5/2007 | Cook et al. | |
| 7,225,879 | B2 | 6/2007 | Wylie et al. | |
| 7,225,880 | B2 | 6/2007 | Braddick | |
| 7,240,729 | B2 | 7/2007 | Cook et al. | |
| 7,278,492 | B2 | 10/2007 | Braddick | |
| 7,350,563 | B2 | 4/2008 | Waddell et al. | |
| 7,441,606 | B2 | 10/2008 | Maguire | |
| 7,543,637 | B2 * | 6/2009 | Green et al. | 166/254.1 |
| 8,100,188 | B2 | 1/2012 | Watson | |
| 2002/0070032 | A1 | 6/2002 | Maguire et al. | |
| 2003/0155159 | A1 | 8/2003 | Slack et al. | |
| 2003/0230410 | A1 | 12/2003 | Underhill | |
| 2004/0173361 | A1 | 9/2004 | Lohbeck | |
| 2004/0256112 | A1 | 12/2004 | Harrall et al. | |
| 2005/0145417 | A1 | 7/2005 | Radford et al. | |
| 2005/0241834 | A1 | 11/2005 | McGlothen et al. | |
| 2005/0263292 | A1 | 12/2005 | Braddick | |
| 2005/0279514 | A1 | 12/2005 | Metcalfe | |
| 2006/0196656 | A1 | 9/2006 | McGlothen et al. | |
| 2006/0272807 | A1 * | 12/2006 | Adam et al. | 166/207 |
| 2007/0000664 | A1 | 1/2007 | Ring et al. | |
| 2007/0029095 | A1 | 2/2007 | Brisco et al. | |
| 2007/0187113 | A1 | 8/2007 | Hester | |
| 2008/0202753 | A1 | 8/2008 | Harrall et al. | |
| 2008/0257560 | A1 | 10/2008 | Brisco et al. | |
| 2009/0107686 | A1 | 4/2009 | Watson | |
| 2010/0155084 | A1 | 6/2010 | Watson et al. | |
| 2011/0011320 | A1 | 1/2011 | Yemington | |

OTHER PUBLICATIONS

Halliburton, "Versaflex Expandable Liner System," H06918, Jun. 2009, 2 pages.
Halliburton, "Versaflex Liner Hanger System," product presentation, dated 2011, 53 pages.
Halliburton, Versaflex brochure, H05234, dated Nov. 2006, 2 pages.
Halliburton drawing No. 59VRT7096400, "Setting Tool Assembly," dated Dec. 22, 2006.
International Search Report issued Aug. 21, 2008, for International Patent Application No. PCT/US08/60106, 2 pages.
Written Opinion issued Aug. 21, 2008, for International Patent Application No. PCT/US08/60106, 4 pages.
International Search Report and Written Opinion issued Feb. 13, 2009, for International Patent Application No. PCT/US08/80423, 9 pages.
Office Action issued Oct. 28, 2009, for U.S. Appl. No. 11/737,868, 14 pages.
Annex to Form PCT/ISA/206 from the International Searching Authority issued Mar. 16, 2010, for International Patent Application No. PCT/US09/068008, 7 pages.
Office Action issued Dec. 9, 2010 for U.S. Appl. No. 12/342,718, 30 pages.
International Preliminary Report on Patentability issued Oct. 29, 2009, for International Patent Application No. PCT/US08/060106, 7 pages.
Office Action issued Mar. 28, 2011, for U.S. Appl. No. 11/737,868, 16 pages.
Office Action issued Jun. 17, 2011, for U.S. Appl. No. 12/342,718, 9 pages.
U.S. Appl. No. 11/923,374, filed Oct. 24, 2007, 36 pages.
International Search Report and Written Opinion issued Feb. 13, 2009, for International Patent Application Serial No. PCT/US08/80423, 9 pages.
International Search Report and Written Opinion issued Aug. 21, 2008, for International Patent Application Serial No. PCT/US08/60106, 7 pages.
Office Action issued Oct. 7, 2008, for U.S. Appl. No. 11/737,868, 24 pages.
Halliburton Completion Tools, Versaflex® Stimulation Acid Washdown (SAW) System, Apr. 2007, 2 pages.
Halliburton Versaflex® Expandable Liner System, Nov. 2006,14 pages.
Halliburton Versaflex® Liner Hanger System, May 21, 2007, 1 page.
Halliburton Versaflex Product Brochure, Nov. 2006, 2 pages.
Halliburton Drawing No. 59VRT7096400, Setting Tool Assembly, Dec. 22, 2006, 9 pages.
Office Action issued Apr. 2, 2009, for U.S. Appl. No. 11/737,868, 15 pages.
Final Office Action issued Oct. 28, 2009, for U.S. Appl. No. 11/737,868, 14 pages.
Office Action issued Jan. 8, 2010, for U.S. Appl. No. 11/923,374, 24 pages.
Office Action issued Mar. 11, 2010, for U.S. Appl. No. 11/737,868, 14 pages.
Partial International Search Report issued for International Patent Application No. PCT/US2009/068008 dated Mar. 16, 2010, 7 pages.
Office Action issued May 12, 2010, for U.S. Appl. No. 11/923,374, 15 pages.
International Preliminary Report on Patentability issued May 6, 2010, for International Patent Application No. PCT/US08/80423, 7 pages.
International Search Report and Written Opinion issued May 31, 2010, for International Patent Application No. PCT/US09/068008, 19 pages.
Office Action issued Aug. 31, 2010, for U.S. Appl. No. 11/923,374, 11 pages.
Office Action issued Oct. 15, 2010, for U.S. Appl. No. 11/737,868, 23 pages.
Office Action issued Dec. 9, 2010, for U.S. Appl. No. 12/342,718, 30 pages.
Office Action issued Oct. 19, 2011, for U.S. Appl. No. 11/737,868, 19 pages.
U.S. Appl. No. 12/954,258 specification and drawings filed Nov. 24, 2010, 31 pages.
English Translation of a Chinese Office Action issued May 21, 2012 for CN Patent Application No. 200880021044.5, 7 pages.
Chinese Office Action issued May 21, 2012 for CN Patent Application No. 200880021044.5, 4 pages.
International Search Report with Written Opinion issued Jun. 29, 2012 for PCT Patent Application No. PCT/US11/060617, 11 pages.
Office Action issued Jul. 18, 2012 for U.S. Appl. No. 11/737,868, 17 pages.
Canadian Office Action issued Apr. 2, 2012 for CA Patent Application No. 2,684,547, 2 pages.
Office Action issued Feb. 25, 2013 for Canadian Patent Application No. 2,780,762, 3 pages.
Office Action issued Aug. 21, 2013 for U.S. Appl. No. 12/954,258, 54 pages.
Malaysian Search Report issued Jun. 3, 2013 for Malaysian Patent Application No. PI 2010001765, 1 page.
Malaysian Examination Report issued Oct. 14, 2013 for Malaysian Patent Application No. PI 2010001765, 2 pages.

* cited by examiner

SETTING TOOL FOR EXPANDABLE LINER HANGER AND ASSOCIATED METHODS

CROSS-REFERENCE TO RELATED APPLICATION

The present application is a continuation of U.S. application Ser. No. 11/923,374 filed on Oct. 24, 2007. The entire disclosure of this prior application is incorporated herein by this reference.

BACKGROUND

The present invention relates generally to equipment utilized and operations performed in conjunction with a subterranean well and, in an embodiment described herein, more particularly provides a setting tool for an expandable liner hanger and associated methods.

Expandable liner hangers are generally used to secure a liner within a previously set casing or liner string. These types of liner hangers are typically set by expanding the liner hangers radially outward into gripping and sealing contact with the previous casing or liner string. Many such liner hangers are expanded by use of hydraulic pressure to drive an expanding cone or wedge through the liner hanger, but other methods may be used (such as mechanical swaging, explosive expansion, memory metal expansion, swellable material expansion, electromagnetic force-driven expansion, etc.).

The expansion process is typically performed by means of a setting tool used to convey the liner hanger and attached liner into a wellbore. The setting tool is interconnected between a work string (e.g., a tubular string made up of drill pipe or other segmented or continuous tubular elements) and the liner hanger.

If the liner hanger is expanded using hydraulic pressure, then the setting tool is generally used to control the communication of fluid pressure, and flow to and from various portions of the liner hanger expansion mechanism, and between the work string and the liner. The setting tool may also be used to control when and how the work string is released from the liner hanger, for example, after expansion of the liner hanger, in emergency situations, or after an unsuccessful setting of the liner hanger.

It is desirable to minimize a wall thickness of the setting tool and liner hanger assembly, so that equivalent circulating density (ECD) is reduced, and so that the assembly can be conveyed rapidly into the well.

It will, therefore, be appreciated that improvements are needed in the art of expandable liner hanger setting tools and associated methods of installing expandable liner hangers. These improvements can include improvements to reduce ECD during running in, to increase operational efficiency, convenience of assembly and operation, improved functionality, etc. whether or not discussed above.

SUMMARY

In carrying out the principles of the present invention, a setting tool and associated methods are provided which solve at least one problem in the art. One example is described below in which the setting tool uses a pressure balanced expansion cone to expand the liner hanger. Another example is described below in which there is no polished bore receptacle (PBR) of the liner hanger which extends upwardly from the expansion cone.

In one aspect, a method of setting an expandable liner hanger in a subterranean well is provided. The method includes the steps of: releasably securing a liner hanger setting tool to the liner hanger, the setting tool including an expansion cone for displacing through the liner hanger; and conveying the setting tool and liner hanger into the well on a generally tubular work string. No portion of the liner hanger extends longitudinally between the expansion cone and the work string in the conveying step.

In another aspect, a liner hanger setting tool for setting an expandable liner hanger in a subterranean well is provided. The setting tool includes an expansion cone, which is displaceable through the liner hanger to expand the liner hanger; at least one piston positioned on one side of the expansion cone; and an anchoring device for releasably securing the setting tool to the liner hanger, the anchoring device being positioned on an opposite side of the expansion cone from the piston. The expansion cone is pressure balanced between its two sides when the expansion cone is displaced through the liner hanger.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
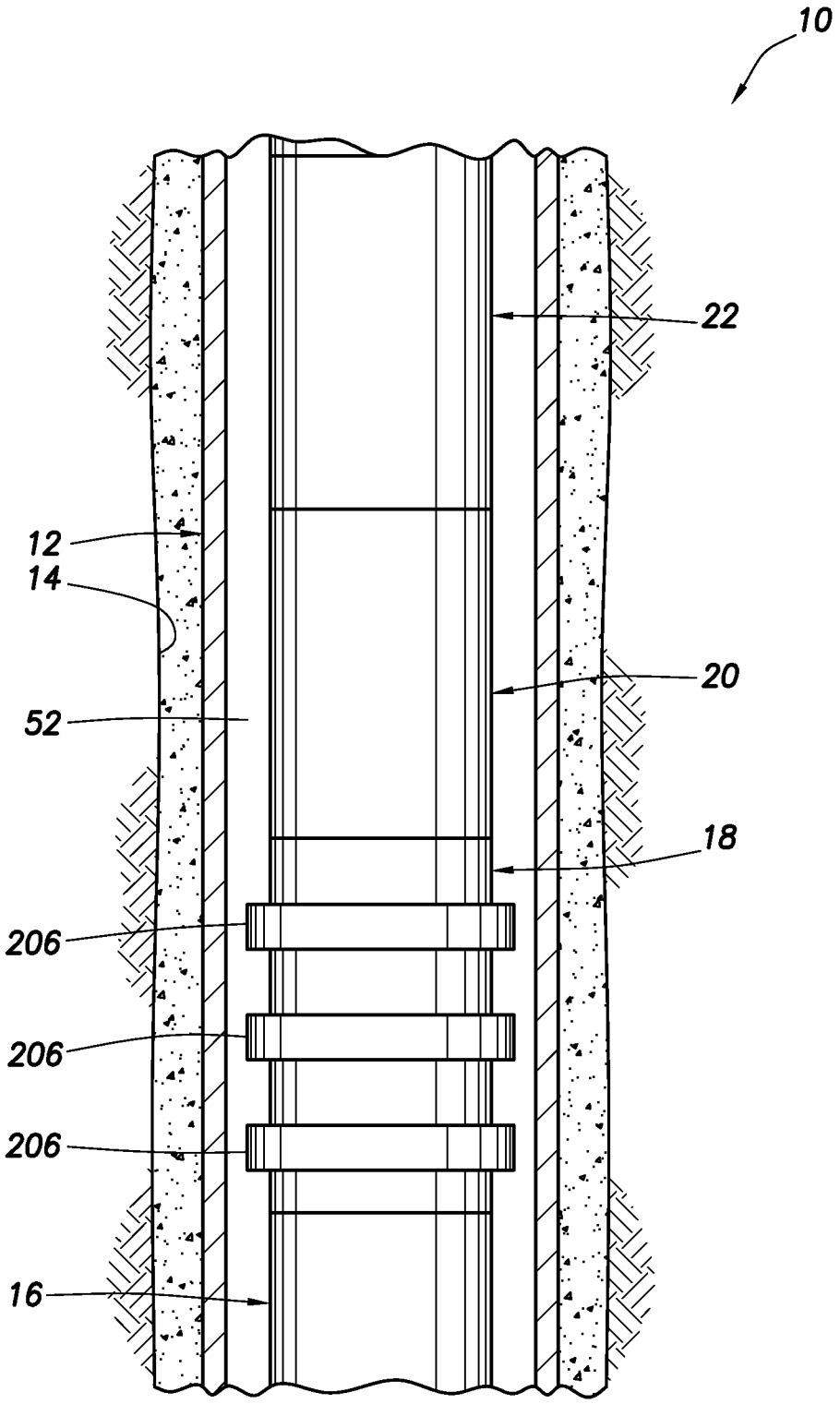
FIG. 1 is a schematic partially cross-sectional view of a liner hanger setting system and associated methods which embody principles of the present invention.

Representatively illustrated in FIG. 1 is a liner hanger setting system 10 and associated method which embody principles of the present invention. In this system 10, a casing string 12 has been installed and cemented within a wellbore 14. It is now desired to install a liner 16 extending outwardly from a lower end of the casing string 12, in order to further line the wellbore 14 at greater depths.

Note that, in this specification, the terms "liner" and "casing" are used interchangeably to describe tubular materials which are used to form protective linings in wellbores. Liners and casings may be made from any material (such as metals, plastics, composites, etc.), may be expanded or unexpanded as part of an installation procedure, and may be segmented or continuous. It is not necessary for a liner or casing to be cemented in a wellbore. Any type of liner or casing may be used in keeping with the principles of the present invention.

As depicted in FIG. 1, an expandable liner hanger 18 is used to seal and secure an upper end of the liner 16 near a lower end of the casing string 12. Alternatively, the liner hanger 18 could be used to seal and secure the upper end of the liner 16 above a window (not shown in FIG. 1) formed through a sidewall of the casing string 12, with the liner extending outwardly through the window into a branch or lateral wellbore. Thus, it will be appreciated that many different configurations and relative positions of the casing string 12 and liner 16 are possible in keeping with the principles of the invention.

A setting tool 20 is connected between the liner hanger 18 and a work string 22. The work string 22 is used to convey the setting tool 20, liner hanger 18 and liner 16 into the wellbore 14, conduct fluid pressure and flow, transmit torque, tensile and compressive force, etc. The setting tool 20 is used to facilitate conveyance and installation of the liner 16 and liner hanger 18, in part by using the torque, tensile and compressive forces, fluid pressure and flow, etc. delivered by the work string 22.

At this point, it should be specifically understood that the principles of the invention are not to be limited in any way to the details of the system 10 and associated methods described herein. Instead, it should be clearly understood that the system 10, methods, and particular elements thereof (such as the setting tool 20, liner hanger 18, liner 16, etc.) are only examples of a wide variety of configurations, alternatives, etc. which may incorporate the principles of the invention.

Referring additionally now to FIGS. 2A-K, detailed cross-sectional views of successive axial portions of the liner hanger 18 and setting tool 20 are representatively illustrated. FIGS. 2A-K depict a specific configuration of one embodiment of the liner hanger 18 and setting tool 20, but many other configurations and embodiments are possible without departing from the principles of the invention.

The liner hanger 18 and setting tool 20 are shown in FIGS. 2A-K in the configuration in which they are conveyed into the wellbore 14. The work string 22 is attached to the setting tool 20 at an upper threaded connection 24, and the liner 16 is attached to the liner hanger 18 at a lower threaded connection 26 when the overall assembly is conveyed into the wellbore 14.

The setting tool 20 is releasably secured to the liner hanger 18 by means of an anchoring device 28 (see FIG. 2K) which includes collets 30 engaged with recesses 32 formed in a setting sleeve 34 of the liner hanger. When operatively engaged with the recesses 32 and outwardly supported by a support sleeve 36, the collets 30 permit transmission of torque and axial force between the setting tool 20 and the liner hanger 18.

The support sleeve 36 is retained in position outwardly supporting the collets 30 by shear pins 38. However, if sufficient pressure is applied to an internal flow passage 40 of the setting tool 20, a piston area between seals 42 will cause the shear pins 38 to shear, and the support sleeve 36 will displace downwardly, thereby unsupporting the collets 30 and allowing them to disengage from the recesses 32.

In addition, the anchoring device 28 can be released by downwardly displacing a generally tubular inner mandrel 44 assembly through which the flow passage 40 extends. The threaded connection 24 is at an upper end of the inner mandrel 44 assembly (see FIG. 2A).

A set of shear screws 46 releasably retain the inner mandrel 44 in position relative to an outer housing assembly 48 of the setting tool 20. If sufficient downward force is applied to the inner mandrel 44 (such as, by slacking off on the work string 22 after the liner hanger 18 has been set, or after tagging the bottom of the wellbore 14 or other obstruction with the liner 16), the shear screws 46 will shear and permit downward displacement of the inner mandrel relative to the outer housing assembly 48.

Figure 3A:
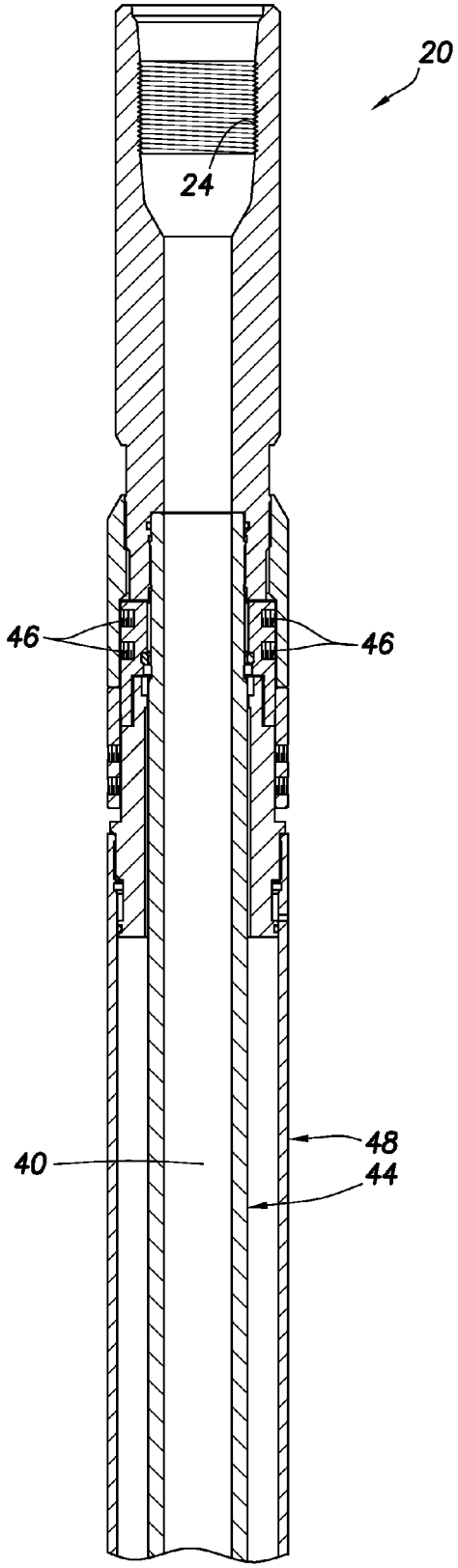
FIGS. 3A & B are cross-sectional views of a portion of the setting tool after a compressive force has been applied from a work string to the setting tool in a release procedure.

In FIGS. 3A & B, portions of the setting tool 20 are representatively illustrated after the inner mandrel 44 has displaced downward relative to the outer housing assembly 48. In FIG. 3A, the sheared screws 46 can be seen, along with the manner in which the inner mandrel 44 is downwardly displaced.

Figure 3B:
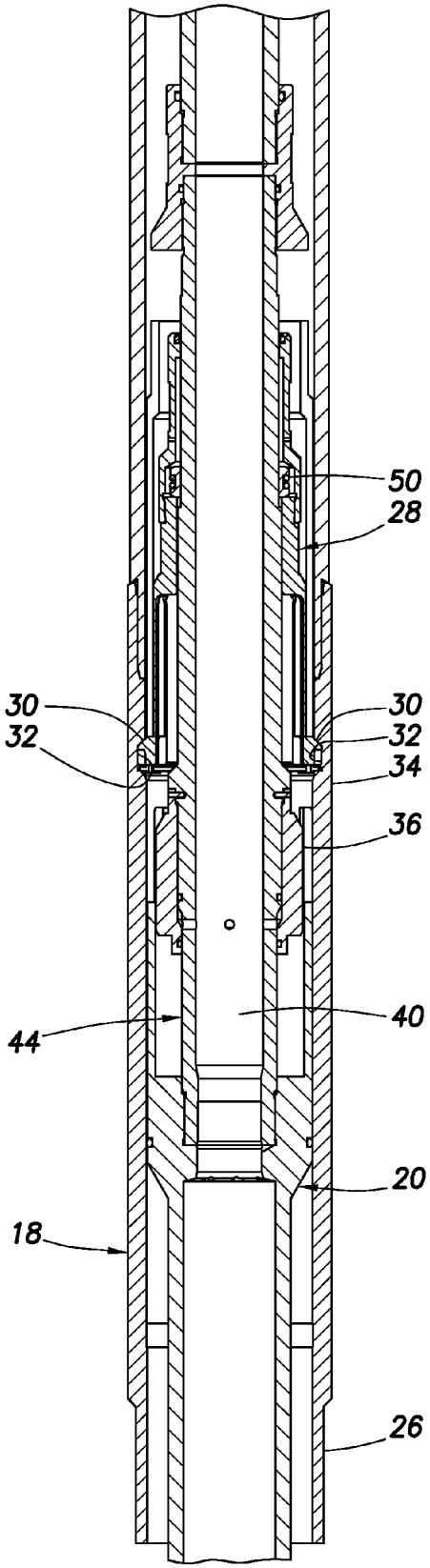

In FIG. 3B, it may be seen that the collets 30 are no longer outwardly supported by the support sleeve 36. The collets 30 can now be released from the recesses 32 by raising the inner mandrel 44 (i.e., by picking up on the work string 22). Locking dogs 50 prevent the support sleeve 36 from again supporting the collets 30 as the inner mandrel 44 is raised.

Note that the setting tool 20 can be released from the liner hanger 18 at any time. For example, the anchoring device 28 would typically be released after the liner hanger 18 is set in the casing string 12, or the anchoring device could be released as a contingency procedure in the event that the liner 16 gets stuck in the wellbore 14.

Returning to FIGS. 2A-K, the setting tool 20 is actuated to set the liner hanger 18 by applying increased pressure to the flow passage 40 (via the interior of the work string 22) to thereby increase a pressure differential from the flow passage to an exterior of the setting tool. The exterior of the setting tool 20 corresponds to an annulus 52 between the wellbore 14 (or the interior of the casing string 12) and the work string 22, setting tool 20, liner hanger 18 and liner 16.

At a certain predetermined pressure differential from the flow passage 40 to the annulus 52, a shear pin 58 retaining a valve sleeve 54 will shear, the valve sleeve will displace upward, and a flapper valve 56 will close. This closing of the flapper valve 56 will isolate an upper portion 40*a* of the flow passage 40 from a lower portion 40*b* of the flow passage (see FIG. 4H). The closed flapper valve 56 will, however, allow pressure to be equalized between the flow passage portions 40*a*, 40*b* when the increased pressure applied to the flow passage 40 via the work string 22 is released.

Figure 2A:
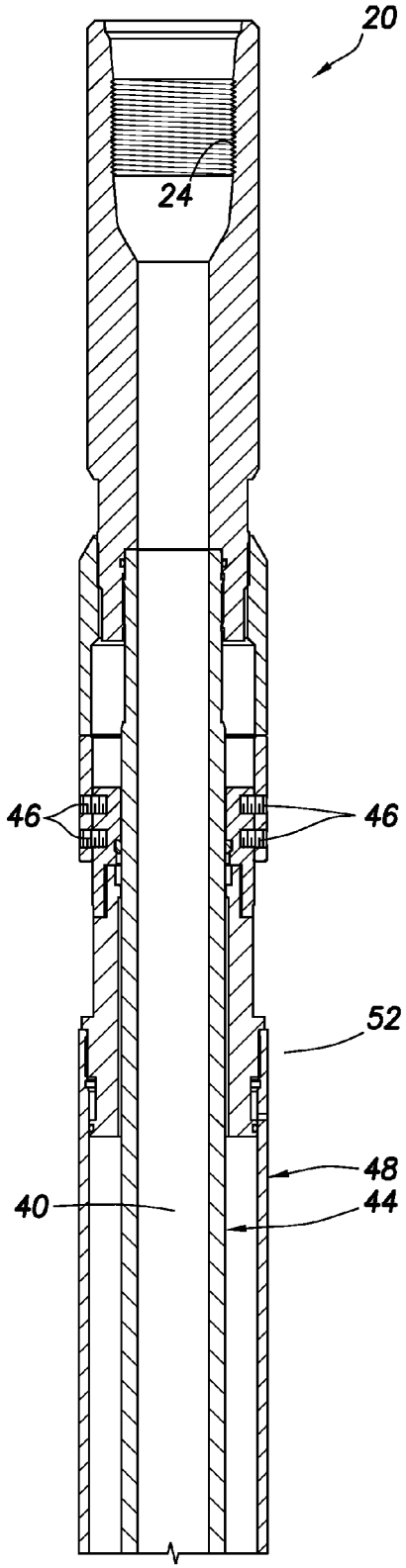
FIGS. 2A-K are cross-sectional views of successive axial sections of a liner hanger setting tool and expandable liner hanger which may be used in the system and method of FIG. 1, the setting tool and liner hanger being illustrated in a run-in configuration.
Figure 2B:
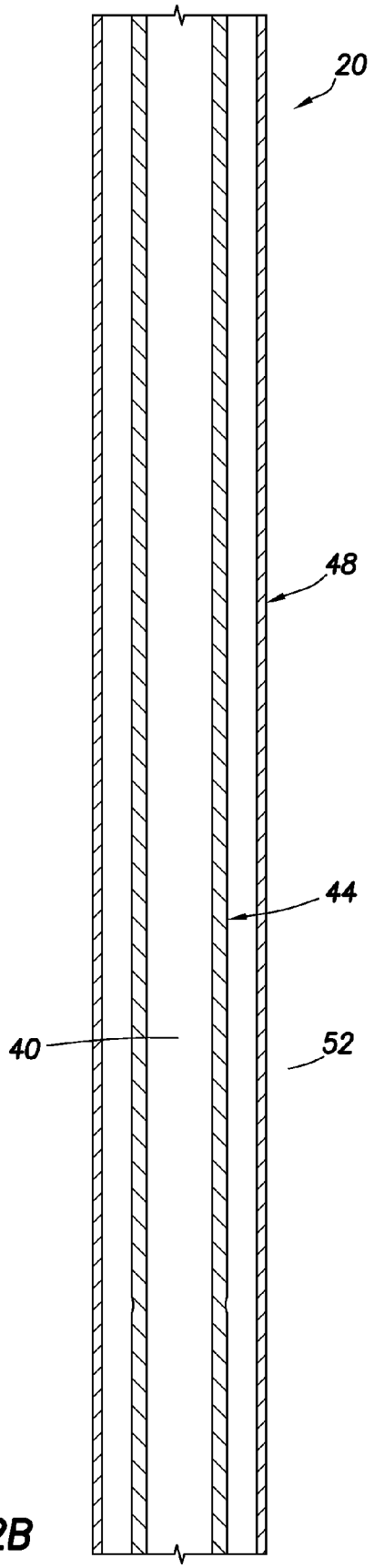
Figure 2C:
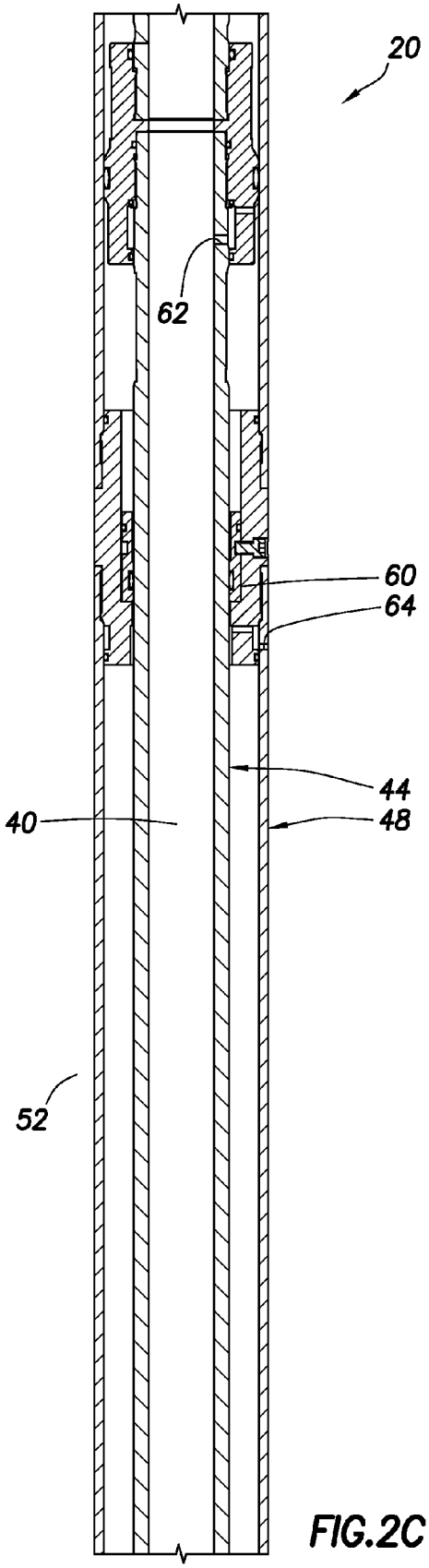
Figure 2D:
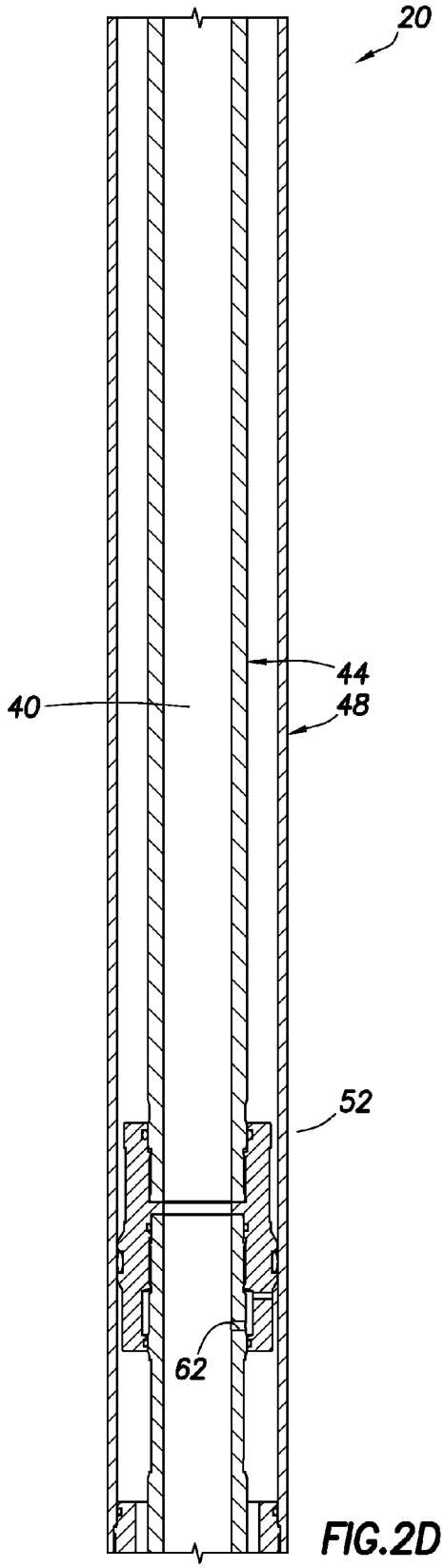
Figure 2E:
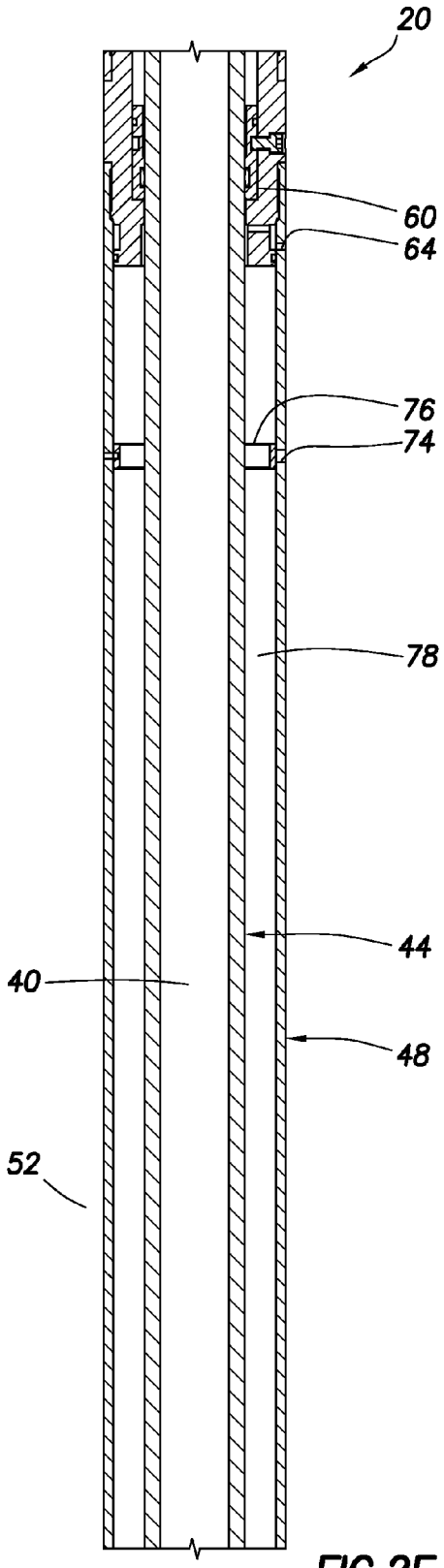
Figure 2F:
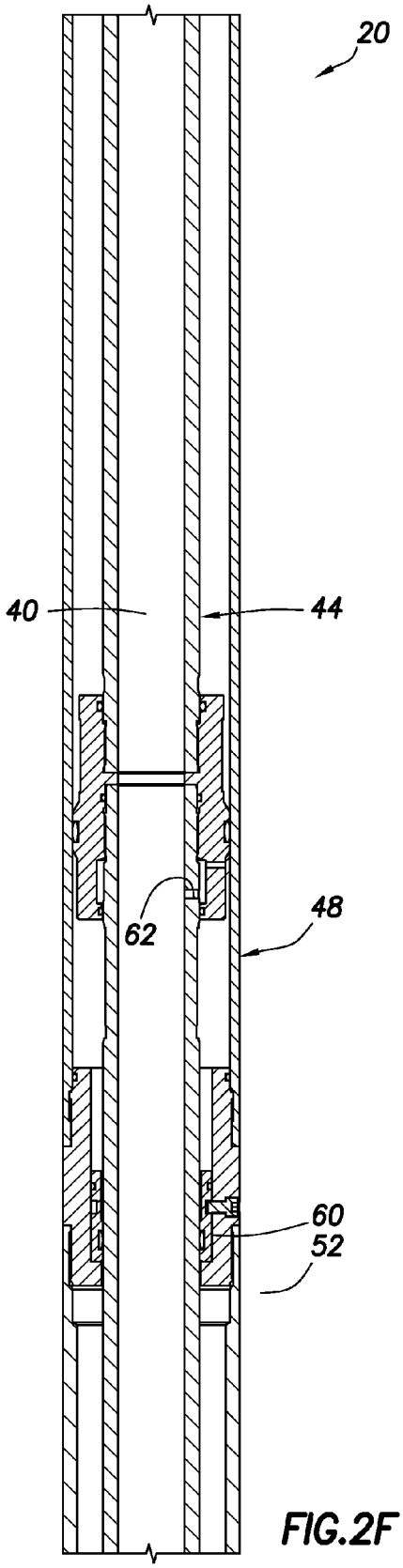
Figure 2G:
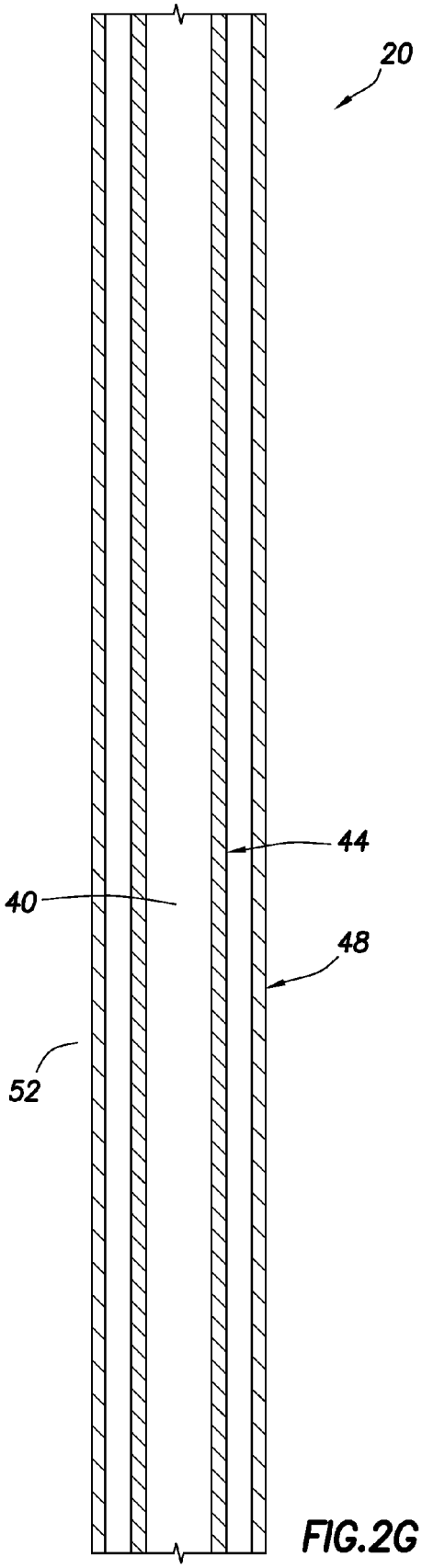
Figure 2H:
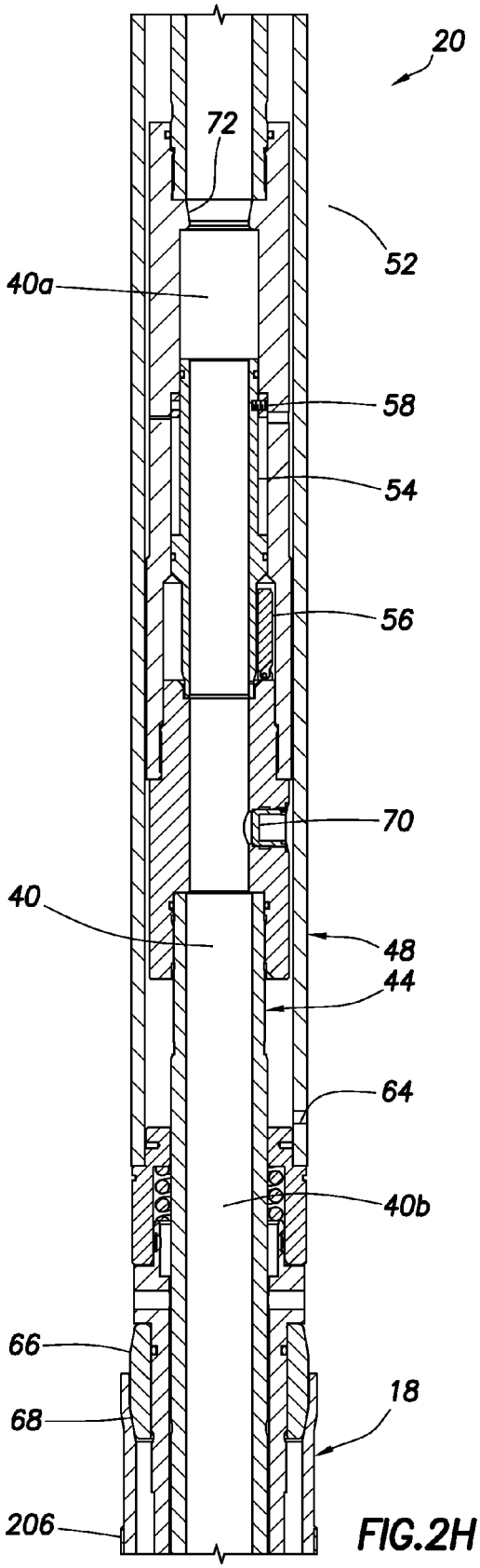
Figure 2I:
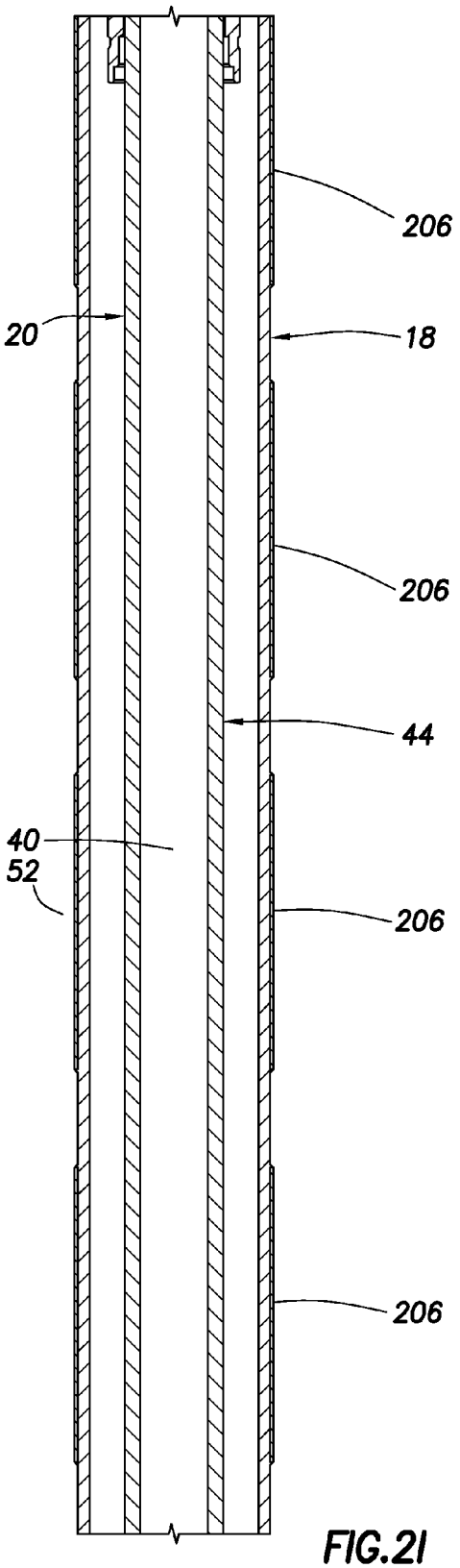
Figure 2J:
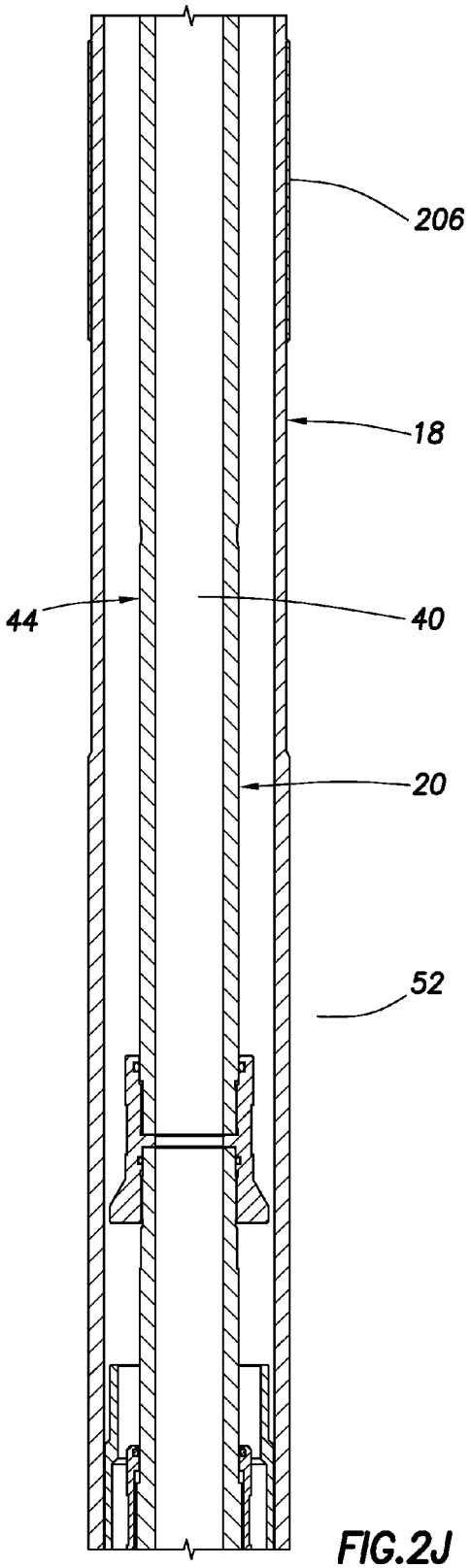
Figure 2K:
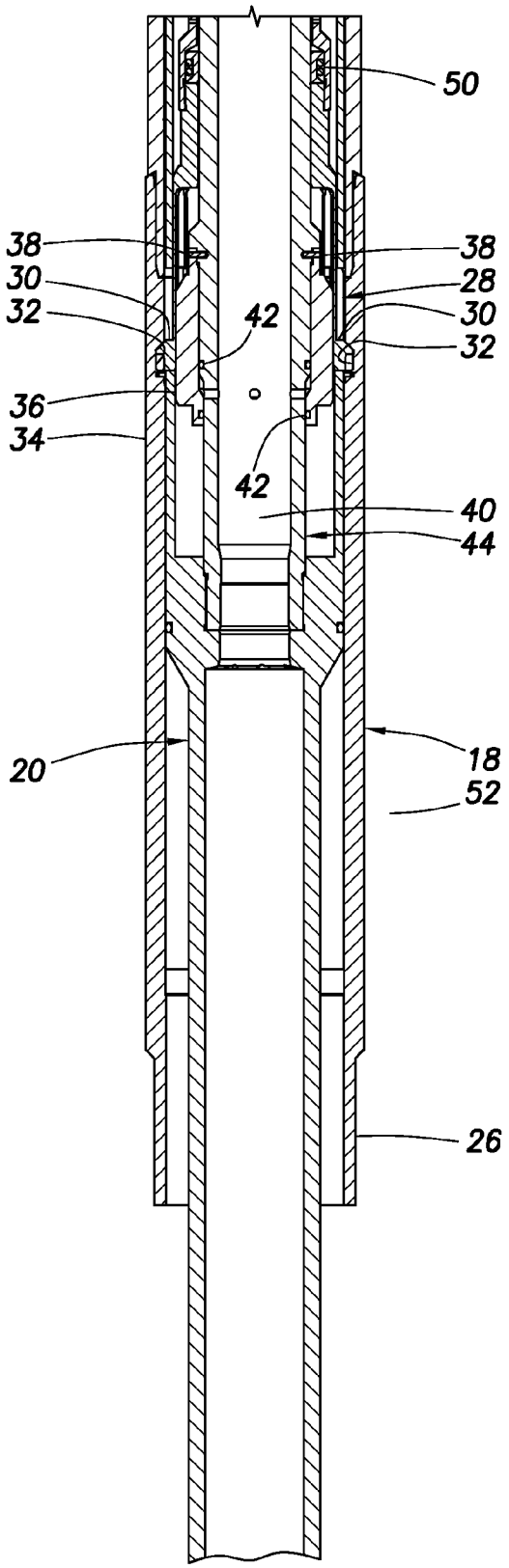

Pressure in the upper flow passage portion 40*a* is then increased again (such as, by applying increased pressure to the work string 22) to apply a pressure differential across three pistons 60 interconnected in the outer housing assembly 48 (see FIGS. 2C, D & F). An upper side of each piston 60 is exposed to pressure in the flow passage 40 via ports 62 in the inner mandrel 44, and a lower side of each piston is exposed to pressure in the annulus 52 via ports 64 in the outer housing assembly 48.

If the valve 56 were to leak when pressure is increased in the upper flow passage portion 40*a*, the increased pressure could possibly be applied via the lower flow passage portion 40*b* to the interior of the liner hanger 18. This could damage the liner hanger 18.

To prevent this from occurring, a venting device 70 is provided below the valve 56. The venting device 70 will vent the lower flow passage portion 40*b* to the annulus 52 (via one of the ports 64) if a pressure differential across the venting device reaches a predetermined limit. The venting device 70 is representatively illustrated in the drawings as a rupture disk, but other types of venting devices, pressure relief devices, etc. may be used, if desired.

If the valve 56 does leak, a ball or other plug (not shown) can be dropped or circulated through the work string 22 to sealingly engage a seat 72 in the inner mandrel 44. This will effectively isolate the upper flow passage portion 40*a* from the lower flow passage portion 40*b*.

An expansion cone 66 is positioned at a lower end of the outer housing assembly 48. The expansion cone 66 has a lower frusto-conical surface 68 formed thereon which is driven through the interior of the liner hanger 18 to outwardly expand the liner hanger. The term "expansion cone" as used herein is intended to encompass equivalent structures which may be known to those skilled in the art as wedges or swages, whether or not those structures include conical surfaces.

Note that only a small upper portion of the liner hanger 18 overlaps the expansion cone 66. This configuration beneficially reduces the required outer diameter of the setting tool 20 and liner hanger 18 assembly, which thereby reduces the equivalent circulating density while circulating through the assembly, and enables the assembly to be conveyed more rapidly into the well.

The differential pressure across the pistons 60 causes each of the pistons to exert a downwardly biasing force on the expansion cone 66 via the remainder of the outer housing assembly 48. These combined biasing forces drive the expansion cone 66 downwardly through the interior of the liner hanger 18, thereby expanding the liner hanger.

Although three of the pistons 60 are illustrated in the drawings and described above, any greater or lesser number of pistons may be used. If greater biasing force is needed for a particular setting tool/liner hanger configuration, then more pistons 60 may be provided. Greater biasing force may also be obtained by increasing a piston area of each of the pistons 60.

The setting tool 20 and liner hanger 18 are representatively illustrated in FIGS. 4A-K after the liner hanger has been expanded. Note that the expansion cone 66 has been displaced downward through the liner hanger 18 to thereby expand the liner hanger radially outward.

Figure 4A:
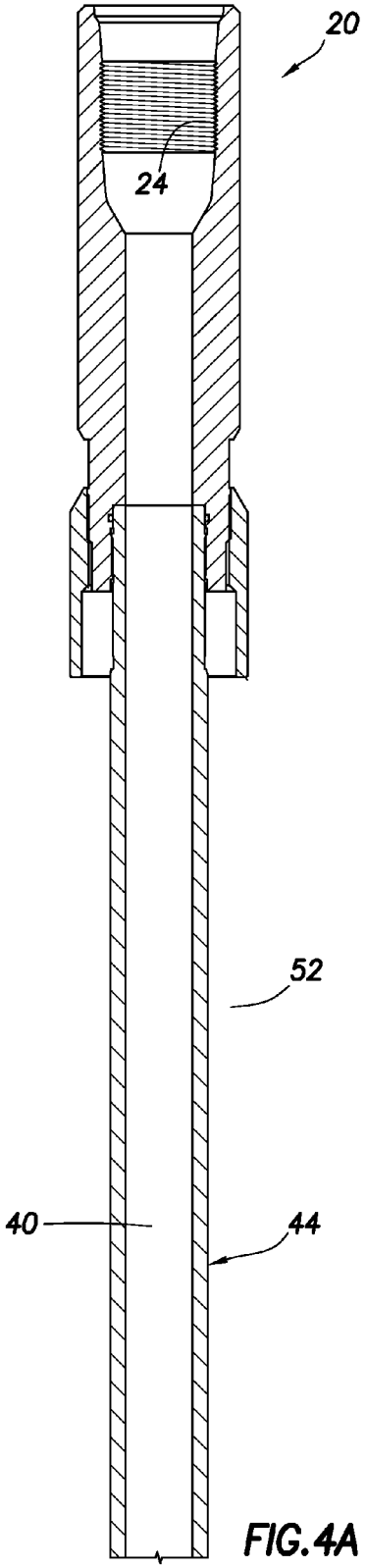
FIGS. 4A-K are cross-sectional views of the setting tool at the conclusion of a liner hanger expansion procedure.
Figure 4B:
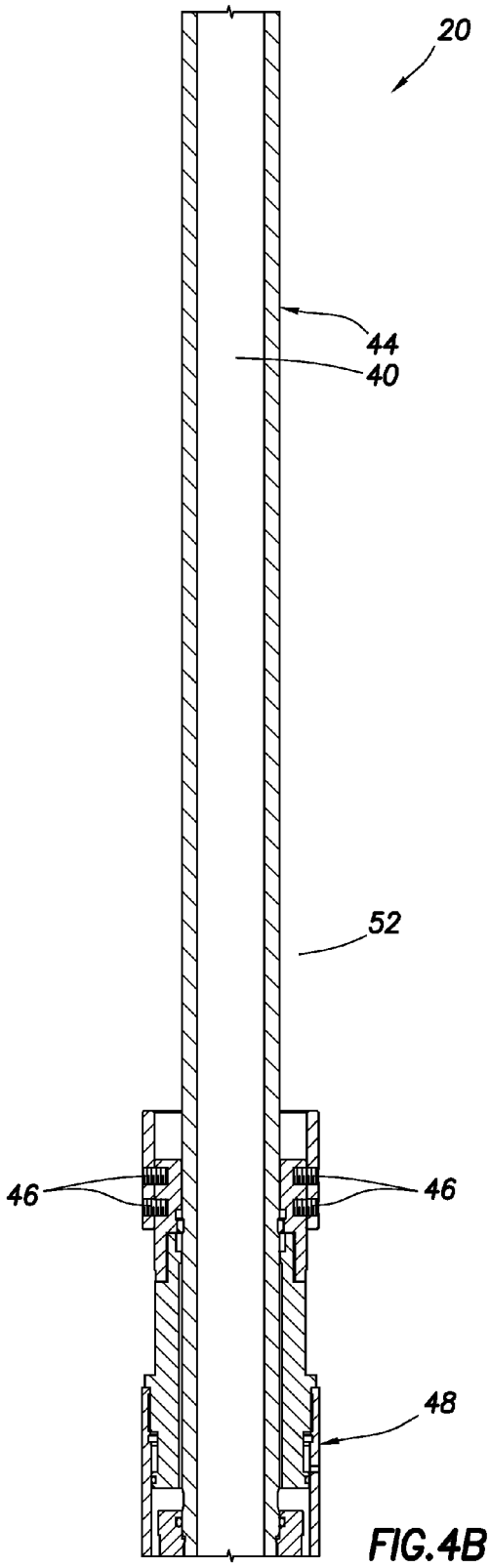
Figure 4C:
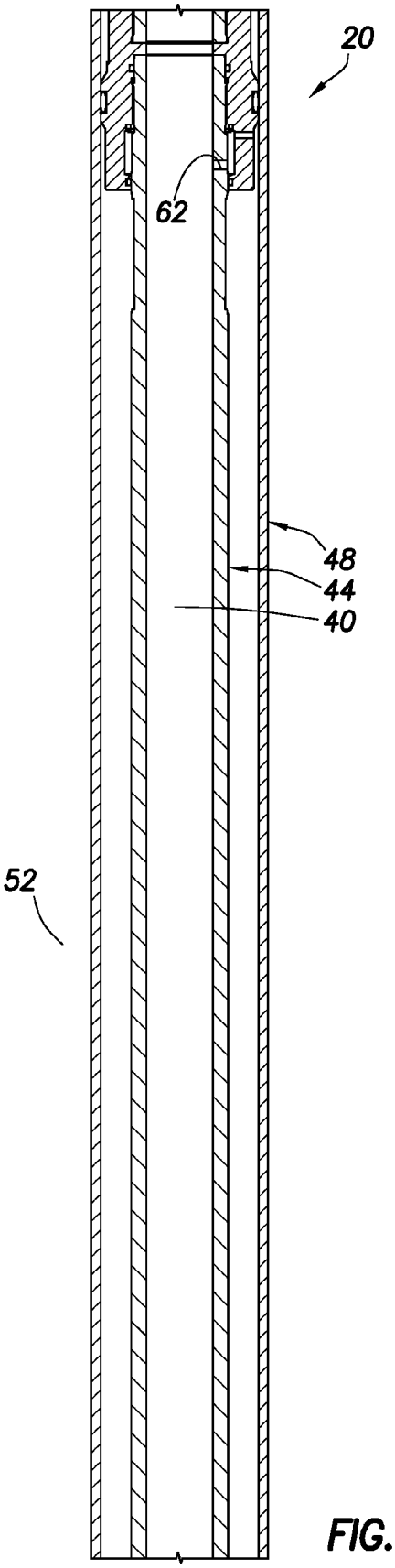
Figure 4D:
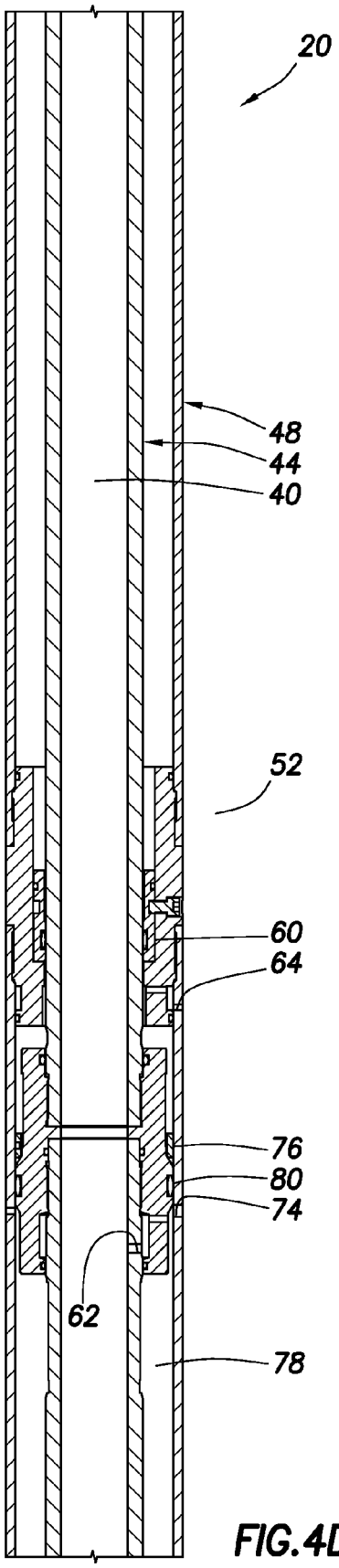
Figure 4E:
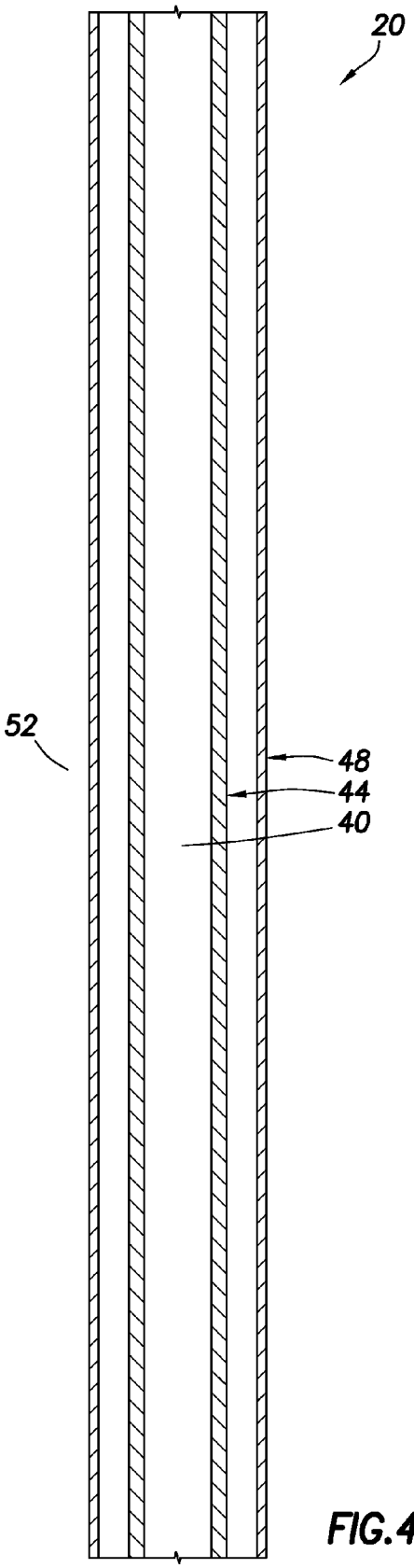
Figure 4F:
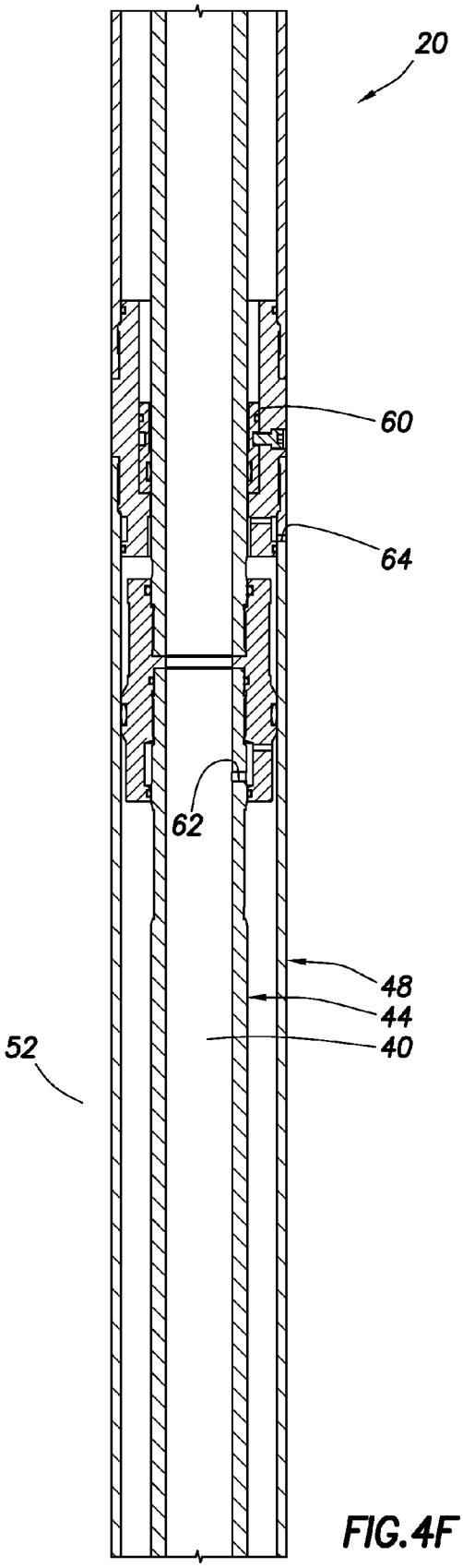
Figure 4G:
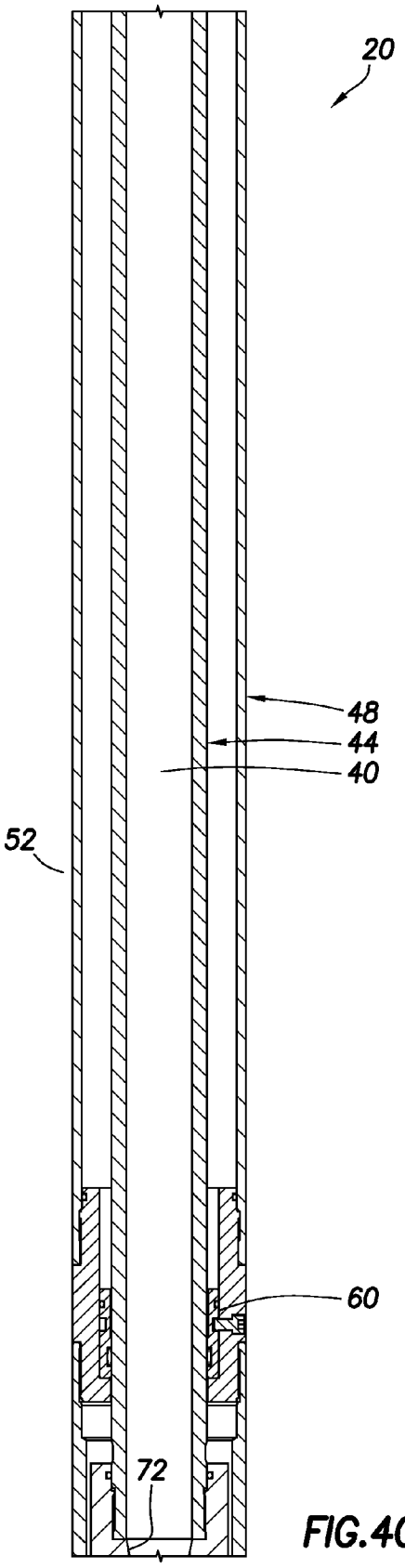
Figure 4H:
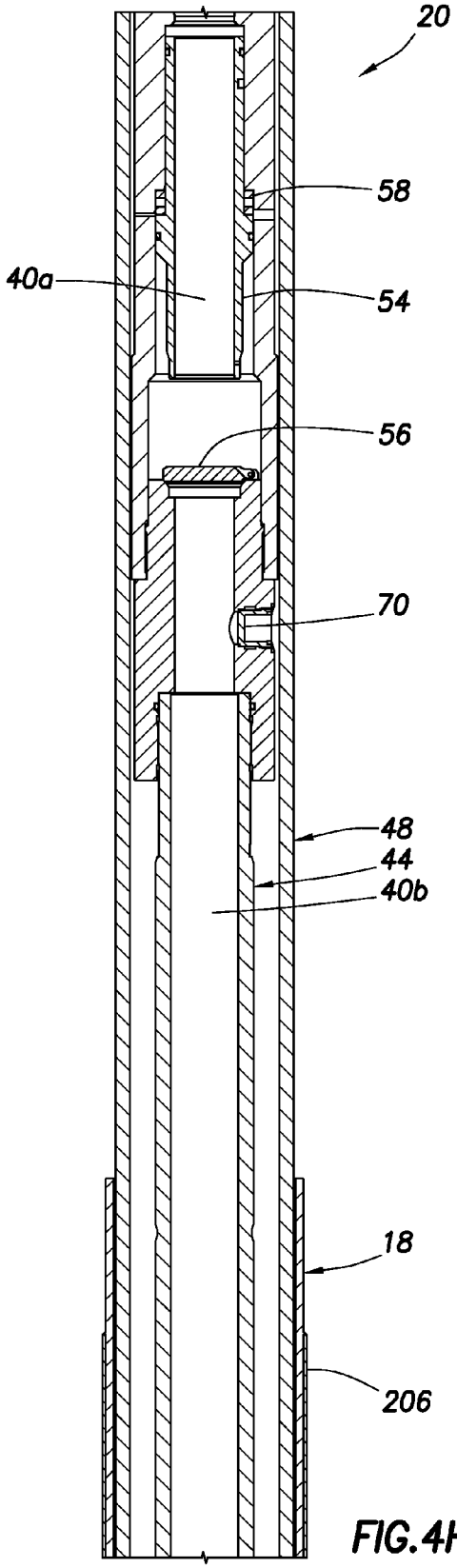
Figure 4I:
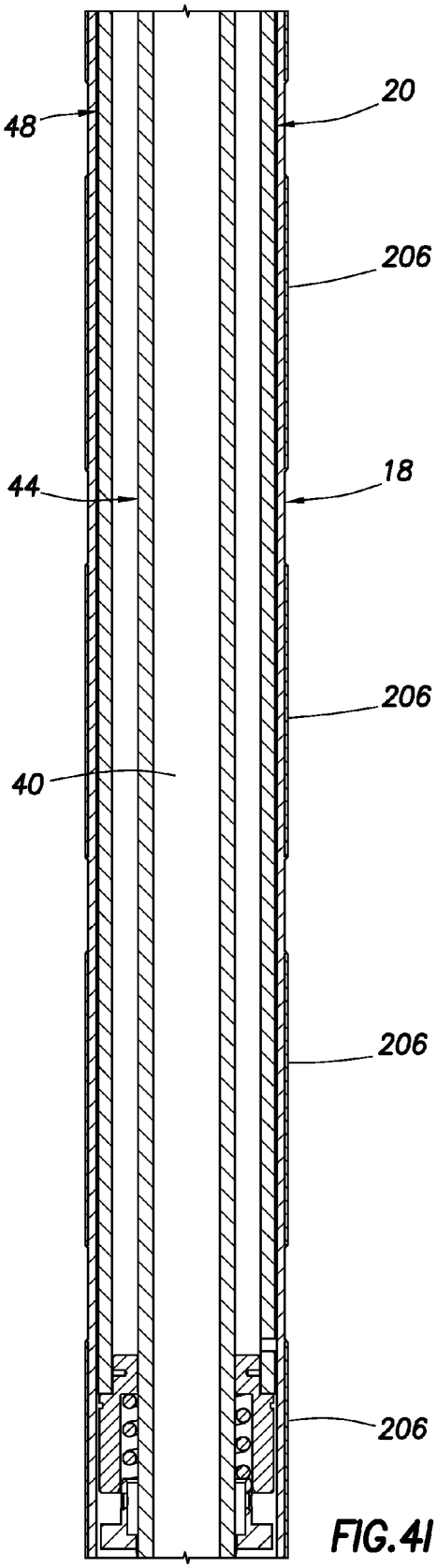
Figure 4J:
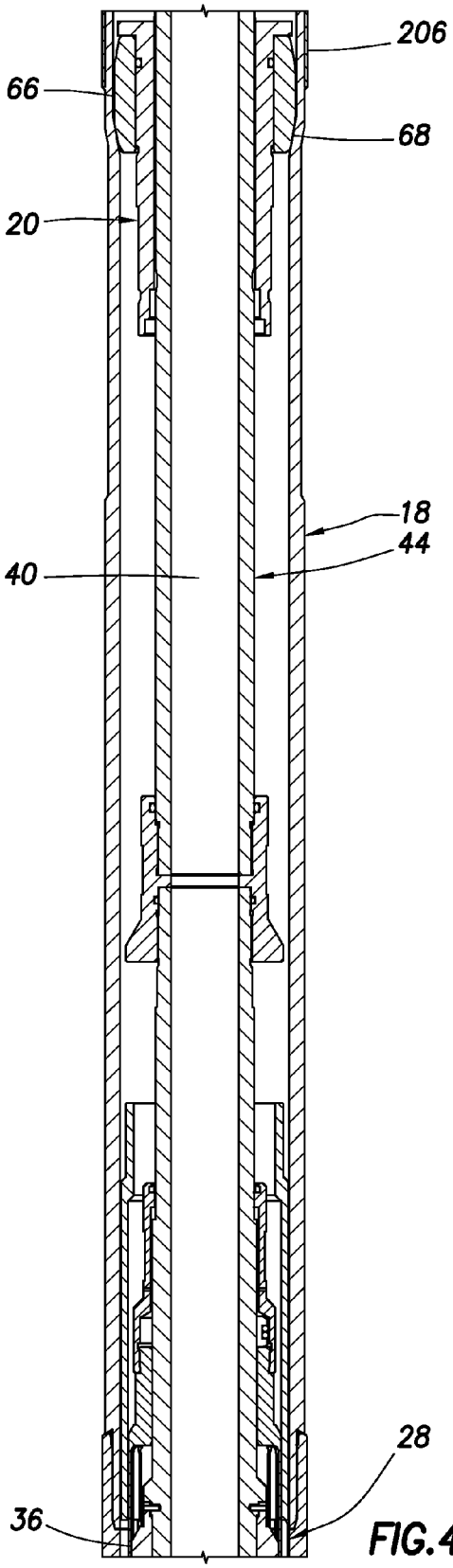
Figure 4K:
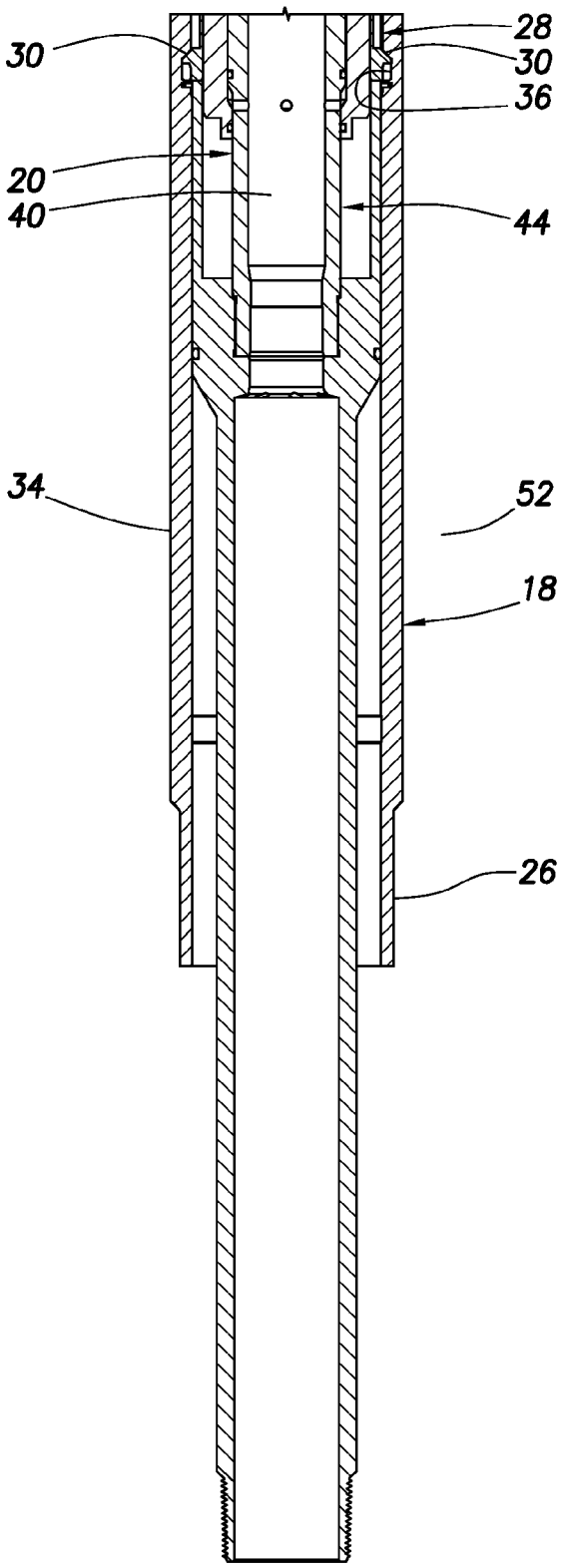

Note that, when the outer housing assembly 48 has displaced downward a predetermined distance relative to the inner mandrel 44, a closure 76 will be contacted and displaced by the inner mandrel to thereby open a port 74 and provide fluid communication between the exterior of the setting tool 20 and an internal chamber 78 exposed to an upper side of one of the pistons 60 (see FIG. 4D). Since the chamber 78 is also in communication with the upper flow passage portion 40*a* above the valve 56 (via one of the ports 62), this operates to equalize pressure between the flow passage 40 and the annulus 52 (or at least provide a noticeable pressure drop at the surface to indicate that the setting operation is successfully concluded). The port 74 may alternatively be placed in fluid communication with the chamber 78 due to the port displacing past a seal 80 carried on the inner mandrel 44 assembly.

With the liner hanger 18 expanded as depicted in FIGS. 4A-K, external seals 206 on the liner hanger 18 would now sealingly and grippingly engage the interior of the casing string 12 in the system of FIG. 1. The inner mandrel 44 can now be displaced downward (i.e., by slacking off on the work string 22) to release the anchoring device 28 as described above. The setting tool 20 can then be retrieved from the well.

It may now be fully appreciated that the system 10, setting tool 20 and associated methods described above provide significant improvements in the art of setting expandable liner hangers. One benefit is that an external diameter of the setting tool 20 and liner hanger 18 may be reduced. This, in turn, reduces equivalent circulating density during circulation, and allows more rapid installation of the setting tool 20 and liner hanger 18 in a well.

The above description, in particular, provides a method of setting an expandable liner hanger 18 in a subterranean well, with the method including the steps of: releasably securing a liner hanger setting tool 20 to the liner hanger 18, the setting tool including an expansion cone 66 for displacing through the liner hanger; and conveying the setting tool and liner hanger into the well on a generally tubular work string 22, wherein no portion of the liner hanger 18 extends longitudinally between the expansion cone 66 and the work string 22.

The method may also include the step of displacing the expansion cone 66 through the liner hanger 18, with the expansion cone being pressure balanced during the displacing step.

The step of releasably securing the setting tool 20 to the liner hanger 18 may include positioning the expansion cone 66 between an anchoring device 28 and the work string 22. The releasably securing step may include positioning the expansion cone 66 between an anchoring device 28 and at least one piston 60.

The method may include the piston 60 displacing the expansion cone 66 through the liner hanger 18 in response to a pressure differential between an exterior 52 of the setting tool 20 and an internal flow passage 40 of the setting tool.

The method may include the step of opening a port 74 providing fluid communication between the exterior of the setting tool 20 and an internal chamber 78 of the setting tool in response to displacement of the piston 60 a predetermined distance.

The setting tool 20 in the method may include multiple pistons 60, and each of the pistons may apply a respective biasing force to the expansion cone 66 in response to the pressure differential. The pistons 60 may be annular shaped and circumscribe a generally tubular inner mandrel 44 of the setting tool 20, and the method may include the step of displacing the inner mandrel 44 to release the anchoring device 28 from the liner hanger 18.

Also provided by the above description is a liner hanger setting tool 20 for setting an expandable liner hanger 18 in a subterranean well. The setting tool 20 may include an expansion cone 66, which is displaceable through the liner hanger to expand the liner hanger; at least one piston 60 positioned on a first side of the expansion cone 66; an anchoring device 28 for releasably securing the setting tool 20 to the liner hanger 18, the anchoring device being positioned on a second side of the expansion cone 66 opposite the first side; and the expansion cone 66 being pressure balanced between its first and second sides when the expansion cone is displaced through the liner hanger 18.

The setting tool 20 may also include a port 74 which is openable to provide fluid communication between an exterior of the setting tool and an inner chamber 78 of the setting tool in response to displacement of the piston 60 a predetermined distance.

At least a portion of the expansion cone 66 may be positioned longitudinally between the liner hanger 18 and the piston 60 when the liner hanger is releasably secured to the setting tool 20.

The piston 60 may be responsive to a pressure differential between an inner flow passage 40 and an exterior of the setting tool 20 to displace the expansion cone 66 through the liner hanger 18.

The setting tool 20 may include a valve 56 which is selectively closable to isolate a first portion of the flow passage 40*a* from a second portion of the flow passage 40*b* in fluid communication with an interior of the liner hanger 18, and a venting device 70 which provides fluid communication between the flow passage second portion 40*b* and the exterior of the setting tool 20 in response to a predetermined pressure differential between the flow passage second portion and the exterior of the setting tool.

The setting tool 20 may include multiple pistons 60, each of the pistons being operative to apply a respective biasing force to the expansion cone 66 in response to the pressure differential. The pistons 60 may be annular shaped and circumscribe a generally tubular inner mandrel 44 of the setting tool 20.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A liner hanger setting tool for setting an expandable liner hanger in a subterranean well, the setting tool comprising:

an expansion cone, which displaces through the liner hanger to expand the liner hanger;

at least one piston positioned on a first side of the expansion cone;

an anchoring device which releasably secures the setting tool to the liner hanger, wherein the anchoring device is positioned on a second side of the expansion cone opposite the first side; and a valve which closes in response to a pressure differential between an inner flow passage and an exterior of the liner hanger setting tool, thereby isolating a first portion of the flow passage from a second portion of the flow passage in fluid communication with an interior of the liner hanger.

2. The setting tool of claim 1, further comprising a port which opens in response to displacement of the piston a predetermined distance, thereby providing fluid communication between an exterior of the setting tool and an inner chamber of the setting tool.

3. The setting tool of claim 1, wherein at least a portion of the expansion cone is positioned longitudinally between the liner hanger and the piston when the liner hanger is releasably secured to the setting tool.

4. The setting tool of claim 1, wherein the piston displaces the expansion cone through the liner hanger in response to the pressure differential.

5. The setting tool of claim 1, further comprising a venting device which provides fluid communication between the flow passage second portion and the exterior of the setting tool in response to a predetermined pressure differential between the flow passage second portion and the exterior of the setting tool.

6. The setting tool of claim 1, wherein the setting tool includes multiple pistons, and wherein each of the pistons applies a respective biasing force to the expansion cone in response to the pressure differential.

7. The setting tool of claim 6, wherein the pistons are annular shaped and circumscribe a generally tubular inner mandrel of the setting tool.

* * * * *